US009881471B2

(12) United States Patent
Miettinen et al.

(10) Patent No.: US 9,881,471 B2
(45) Date of Patent: Jan. 30, 2018

(54) ELECTRONIC ARTICLE SURVEILLANCE TAG

(71) Applicant: Noccela Oy, Turku (FI)

(72) Inventors: Riku Tapio Miettinen, Turku (FI); Heikki Tapani Talvitie, Littoinen (FI)

(73) Assignee: NOCCELA OY, Turku (FI)

( * ) Notice: Subject to any disclaimer, the term of this patent is extended or adjusted under 35 U.S.C. 154(b) by 0 days.

(21) Appl. No.: 15/018,937

(22) Filed: Feb. 9, 2016

(65) Prior Publication Data

US 2016/0328933 A1 Nov. 10, 2016

(30) Foreign Application Priority Data

May 4, 2015 (GB) ..... 1507628.4

(51) Int. Cl.
*G08B 13/14* (2006.01)
*G08B 13/24* (2006.01)

(52) U.S. Cl.
CPC ..... *G08B 13/2434* (2013.01); *G08B 13/2448* (2013.01)

(58) Field of Classification Search
CPC . B65D 55/14; E05B 73/0041; E05B 73/0017; Y10T 70/5004; Y10T 70/7057; Y10T 70/7751; G08B 13/2434; G08B 13/2448
USPC ..... 340/571.1–572.9, 568.1, 539.1, 568.5, 340/568.7, 568.8, 571
See application file for complete search history.

(56) References Cited

U.S. PATENT DOCUMENTS

| | | | | |
|---|---|---|---|---|
| 5,793,290 | A | 8/1998 | Eagleson et al. | |
| 6,731,212 | B2 | 5/2004 | Hirose et al. | |
| 7,073,236 | B2 * | 7/2006 | Xue | E05B 73/0017 24/704.1 |
| 7,190,272 | B2 * | 3/2007 | Yang | G08B 13/2434 340/568.1 |
| 8,274,391 | B2 | 9/2012 | Yang | |
| 8,408,472 | B2 | 4/2013 | Yang | |
| 9,091,100 | B2 | 7/2015 | Yang | |
| 2002/0158762 | A1 | 10/2002 | Nguyen et al. | |
| 2002/0171550 | A1 | 11/2002 | Hirose et al. | |

(Continued)

FOREIGN PATENT DOCUMENTS

WO 2002/086832 A1 10/2002

OTHER PUBLICATIONS

UK Intellectual Property Office Search report dated Nov. 12, 2015 in appln. No. GB1507628.4.

(Continued)

*Primary Examiner* — Daniel Previl
(74) *Attorney, Agent, or Firm* — Berggren Inc.

(57) ABSTRACT

The present invention relates to an electronic article surveillance tag that comprises at least one receptacle for receiving a pin. Each of the at least one receptacle comprises a plurality of balls supported by a ball cage for releasably locking the pin in the receptacle, a cone shaped cup arranged in contact with the plurality of balls, a first spring for supporting the ball cage into the cone shaped cup, and a conductive element, the first end of which is arranged in contact with the cone shaped cup and the second end of which is arranged in contact with a contact element inside the electronic article surveillance tag for conducting electrical current from the pin to the contact element.

13 Claims, 3 Drawing Sheets

(56) References Cited

U.S. PATENT DOCUMENTS

| | | | | |
|---|---|---|---|---|
| 2004/0163430 | A1* | 8/2004 | Belden, Jr. | B65D 55/14 70/57.1 |
| 2007/0205902 | A1* | 9/2007 | Cote | E05B 73/0017 340/572.9 |
| 2008/0303670 | A1 | 12/2008 | Seidel | |
| 2009/0033497 | A1* | 2/2009 | Wyatt, Jr. | G08B 13/2434 340/572.1 |
| 2010/0085192 | A1* | 4/2010 | Nagelski | E05B 73/0017 340/572.9 |
| 2012/0229975 | A1 | 9/2012 | Yang | |
| 2013/0147625 | A1 | 6/2013 | Sayegh et al. | |
| 2015/0048947 | A1 | 2/2015 | Yang | |

OTHER PUBLICATIONS

European Patent Office, Rijswijk, NL, Aurel Dascalu, International Search Report, PCT/FI2017/050073, dated Jun. 6, 2017.

* cited by examiner

ELECTRONIC ARTICLE SURVEILLANCE TAG

PRIORITY

This application claims priority of UK national application number GB 1507628.4 filed on May 4, 2015, the contents of which is incorporated herein by reference in its entirety.

TECHNICAL FIELD OF THE INVENTION

The present invention relates to electronic article surveillance (EAS) tags, and more particularly, to locking receptacles used in EAS tags.

BACKGROUND OF THE INVENTION

Electronic article surveillance (EAS) tags are commonly used to prevent shoplifting and other similar attempts to take goods outside a controlled area in a store. Usually, EAS tags are sensor tags, which are affixed to articles to be protected. The EAS tags are detected with a detection system, which is used at the exits of the store. If the article with the active EAS tag is carried out from the store, the detection system senses the tag and triggers an alarm. EAS tags are difficult to remove from the goods without a special release device, which is normally used by an authorised person, after the article has been bought or checked out.

To prevent an unauthorised removal of the EAS tag from an article, different mechanisms for locking an attaching element to the body of the EAS tag has been used. The attaching element for the EAS tag is conventionally a pin or a lanyard with a pin at the end. The locking mechanism utilises, for example, balls for locking the pin into the EAS tag body. This locking mechanism prevents the removal of the pin from the EAS tag body and can typically be opened with a strong magnet.

An electrical detection for sensing the unauthorised pin removal from the EAS tag body has been utilised with the locking mechanisms. A problem of these detection systems is the lack of reliability and the amount of mis-alarms. The assembly of the EAS tags with the known detection systems is difficult and not cost-effective.

There is, therefore, a need for a more reliable, simple and inexpensive solution for the pin detection of the EAS tag.

SUMMARY OF THE INVENTION

It is the main objective of the present invention to reduce or even eliminate the prior art problems presented above.

It is an objective of the present invention to provide an EAS tag with the pin detection.

It is a further objective of the present invention to increase the reliability of the EAS tag and in more detail to provide a reliable way to detect that the pin is in place in the EAS tag.

It is also an objective of the present invention to provide a simple and more profitable EAS tag with the pin detection.

In order to realise the above-mentioned objectives, the electronic article surveillance tag according to the invention is characterised by what is presented in the appended independent claim. Advantageous embodiments of the invention are described in the dependent claims.

DESCRIPTION OF THE INVENTION

A typical electronic article surveillance (EAS) tag according to the invention comprises at least one receptacle for receiving a pin. In a typical EAS tag according to the invention each of the at least one receptacle comprises a plurality of balls supported by a ball cage for releasably locking the pin in the receptacle, a cone shaped cup arranged in contact with the plurality of balls, a first spring for supporting the ball cage into the cone shaped cup, and a conductive element having a first end and a second end, the first end being arranged in contact with the cone shaped cup and the second end being arranged in contact with a contact element inside the electronic article surveillance tag for conducting electrical current between the pin and the contact element. An EAS tag according to the invention may be used to protect an article from shoplifters. The EAS tag may be attached to the article with at least one attaching element, which may be a pin pressed through a cloth and locked in the receptacle by the locking mechanism or a lanyard looped around an object and locked in the receptacle by the locking mechanism. The pin may be a part of a tack having a sharp or blunt end. The tack may be inserted and releasably locked to the receptacle. The lanyard comprises a conducting wire, which may have a first pin connected to the first end and a second pin connected to the second end. The first pin may be inserted and releasably locked in the first receptacle and the second pin may be inserted and releasably locked in the second receptacle. The lanyard may alternatively comprise a first end, which is fixed to the EAS body, and the second end with a pin, which may be inserted and releasably locked to the receptacle. In the EAS tag according to the invention, the at least one receptacle is fitted inside the EAS tag body. Preferably the EAS tag has two receptacles. The EAS tag may have more than two receptacles.

The receptacles are electrically coupled via contact elements to a control unit inside the EAS tag body. The control unit may be a processor, for example, a microcontroller. When both pins of the lanyard are locked in the receptacles, the pins are electrically coupled to the control unit via contact elements inside the EAS tag. The control unit may detect if the electrical current is conveyed via the lanyard between the first receptacle and the second receptacle. In other words, the control unit may detect if the pins of the lanyard are locked to the receptacles or released from the receptacles or if the lanyard is broken.

Also the fixed end of the lanyard may be electrically coupled via a contact element to a control unit inside the EAS tag body. So, in a case where the lanyard with the first end is fixed to the EAS body and the second end with a pin is locked in the receptacle, the pin and the fixed end of the lanyard are electrically coupled via contact elements to the control unit inside the EAS tag body. Thus, when the pin of the lanyard is locked to the receptacle, the control unit may detect if the electrical current is conveyed via lanyard between the fixed end and the receptacle. Thus, the control unit may detect if the pin at the second end of the lanyard is locked to the receptacle or released from the receptacle or if the lanyard is broken.

The pin is inserted to the receptacle through an aperture at the EAS tag body. In the receptacle, the plurality of balls is used to lock the pin. The number of balls is preferably three. The balls are preferably round in shape for better rolling along the pin surface when inserting or releasing the pin. The balls are arranged in the ball cage that is preferably cylindrical in shape and made at least partially of a magnetically attractable material, for example, iron, nickel or cobalt. The ball cage is hollow along its longitudinal axis, and has a plurality of ball apertures. The number of ball apertures is preferably three. The ball cage has also an aperture for the pin at the top surface. The balls are located in the ball apertures of the ball cage. The assembly of the ball cage and the balls is fitted inside the cone shaped cup, which is open at the large end of the cone, so that the balls are in contact with the cone shaped cup. The contact between the balls and the cone shaped cup ensures the electrical connection between them. The conical shape of the cup enables transversal movement of the balls when moving the ball cage in an axial direction, in a situation when the pin is inserted or released. To avoid the falling of the ball cage from the cone shaped cup during locking or unlocking the pin, the first spring is holding up the ball cage inside the cone shaped cup. The first spring may be a coil spring and made of an elastic material, preferably metal. The first spring may be formed into the shape of a helix. The first spring is a compression type spring. It resists compression when loaded and returns to its natural length when unloaded.

The edges of the cone shaped cup may be slightly bended inside from the small end of the cone defining an aperture for the pin. The cone shaped cup is attached to an outer cap from the large end. The outer cap is preferably conical and open at the large end of the cone. The small end of the cone may be arranged to rest at the bottom of the EAS tag body, so that the apertures in the cone shaped cup and the ball cage align with the aperture of the EAS tag body. The conductive element is used between the cone shaped cup and the contact element in the EAS tag body for conducting electricity between the balls and the contact element. The conductive element may be, for example, a spring, wire or foam made of a flexible and electrically conductive material. The flexibility of the conductive element allows movement between the surfaces and increases the durability of the contact. The first end of the conductive element may be in contact with the small end surface of the cone shaped cup or with the side surface of the cone shaped cup. The second end of the conductive element may be in direct contact with the contact element or mechanically attached by soldering or gluing with, for example, electrically conductive glue.

When the pin is inserted to the receptacle, the pin pushes the balls and the ball cage slightly down. The balls encircle the pin and the first spring supports the ball cage in the cone shaped cup to maintain the contact between the cone shaped cup, balls and pin. Thus, if an attempt is made to withdraw the pin, the balls, pin and cone shaped cup create a wedging action preventing the pin from being withdrawn. To release the pin from the receptacle, a special release device, for example, a strong magnet is applied to the back of the receptacle. The magnetically attractable ball cage is pulled partially from the cone shaped cup to the area which gives a space to the balls and the pin. This allows the pin to be withdrawn from the receptacle.

The contact element is electrically connected to the control unit inside the EAS tag. The control unit may be configured to monitor whether an electrical connection is present or not. The control unit may be a processor, for example, a microcontroller. In a case when the lanyard is used as an attaching element, the first pin is inserted to the first receptacle and the second pin is inserted to the second receptacle. The first and the second pin close the electric circuit, which can be detected by the microcontroller. If the first pin or the second pin is detached from the receptacle or the lanyard is cut, the electrical connection breaks. This is detected by the microcontroller. The microcontroller may be arranged to give an alarm.

According to an embodiment of the invention the conductive element is a second spring. The second spring is a compression type resisting compression when loaded and returning to the natural length when unloaded. The second spring may be arranged between the cone shaped cup and the contact element, so that the spring is in compressed state and creates a tight contact between the spring, cone shaped cup and contact element. The advantage of using the spring as a conductive element between the cone shaped cup and the contact element is that, the spring allows movement between the surfaces and impacts to the EAS tag without losing the contact. This increases the reliability of the EAS tag and reduces mis-alarms. Additionally, the EAS tag works longer and the retailer manages to avoid extra costs for providing new tags. The further advantage of using the spring as the conductive element is that, the EAS tag is easier to assemble.

According to an embodiment of the invention the second spring is a conical coil spring. The coil spring is easier to assemble between the cone shaped cup and the contact element than, for example, a leaf spring. There is no need to mechanically attach the coil spring to the contact element for having a reliable contact. Also the assembly of the EAS tag is easier. The conical shape of the spring allows the spring to be compressed into a spiral and thus the smallest possible thickness to reduce the overall thickness of the EAS tag. Due to the conical shape of the first coil spring, a better contact to the cone shaped cup is achieved.

According to an embodiment of the invention the diameter of the conical coil spring is larger at the first end than at the second end. The difference between the diameter of the first and the second end enables the spring to be compressed into the smallest possible thickness.

According to an embodiment of the invention an inner surface of at least one coil of the second spring is in contact with the outer surface of the cone shaped cup. The second end of the second spring is assembled over the outer side surface of the cone shaped cup. This way a better contact and adhesion between the spring coils and the outer side surface of the cone shaped cup may be achieved. This kind of contact increases the reliability of the electrical connection and a risk for losing the contact is low.

According to an embodiment of the invention the ball cage and the plurality of balls are arranged inside the cone shaped cup, so that the balls are in contact with the inner surface of the cone shaped cup.

According to an embodiment of the invention the contact element is a contact pad of a circuit board.

According to an embodiment of the invention the plurality of balls, the cone shaped cup and the first spring are made of an electrically conductive material. The electrically conductive material may be, for example, metal. Preferably the electrically conductive material of the balls, cone shaped cup and the first spring may be copper, aluminium or silver.

According to an embodiment of the invention the first spring has a first end and a second end, the first end being arranged in contact with the bottom of the receptacle. The first end of the first spring may rest at the inner surface of the outer cap, at the bottom of the receptacle. In the receptacle, the first spring controls the axial movement of the ball cage inside the cone shaped cup when inserting or releasing the pin. The first spring may also prevent the ball cage from falling out from the cone shaped cup and ensures that the balls and the cone shaped cup are in contact.

According to an embodiment of the invention the second end of the first spring is arranged in contact with a spring plate of the ball cage. An advantage of using the spring plate is that the balls are not in contact with the last coil of the spring and the surface of the balls is not affected to wearing due to the contact. The spring plate may also give more even and stationary support to the spring.

According to an embodiment of the invention the electronic article surveillance tag comprises an attaching element having at least one pin that can be inserted and locked into the receptacle. The attaching element may be a tack when there is one pin. The pin may be sharp or blunt from the end. The pin may be inserted to the receptacle and releasably locked by the locking mechanism in the receptacle. The attaching element may also be a lanyard, which comprises a conducting wire having a first pin connected to the first end and a second pin connected to the second end. The first pin may be inserted to the first receptacle and releasably locked by the locking mechanism in the first receptacle. The second pin may be inserted to the second receptacle and releasably locked by the locking mechanism in the second receptacle. Additionally, the lanyard may be fixed to the EAS tag from the first end and have a pin at the second end. Thus, only the second end of the lanyard may be inserted to the receptacle and releasably locked by the locking mechanism of the receptacle. The lanyard may also be, for example, a peeled multifilament or solid wire where the end of the wire acts as a pin. In that case, the wire end may be inserted to the receptacle and locked by the locking mechanism in the receptacle.

According to an embodiment of the invention the pin has a groove for engaging with the plurality of balls. The groove is preferably round in shape and extends around the pin. The groove may be sized to fit the plurality of the balls to give wider contact surface and more stable locking. This ensures a better electrical contact between the pin and the balls.

According to an embodiment of the invention the pin is made of an electrically conductive material. The electrically conductive material may be, for example, metal. Preferably, the electrically conductive material of the pin may be copper, aluminium or silver. Also the conducting wire is made of an electrically conductive material which may be, for example, metal. Preferably, the electrically conductive material of the conducting wire may be copper, aluminium or silver.

The exemplary embodiments of the invention presented in this text are not interpreted to pose limitations to the applicability of the appended claims. The verb "to comprise" is used in this text as an open limitation that does not exclude the existence of also unrecited features. The features recited in the dependent claims are mutually freely combinable unless otherwise explicitly stated.

DETAILED DESCRIPTION OF THE DRAWINGS

The same reference signs are used of the same or like components in different embodiments.

Figure 1:
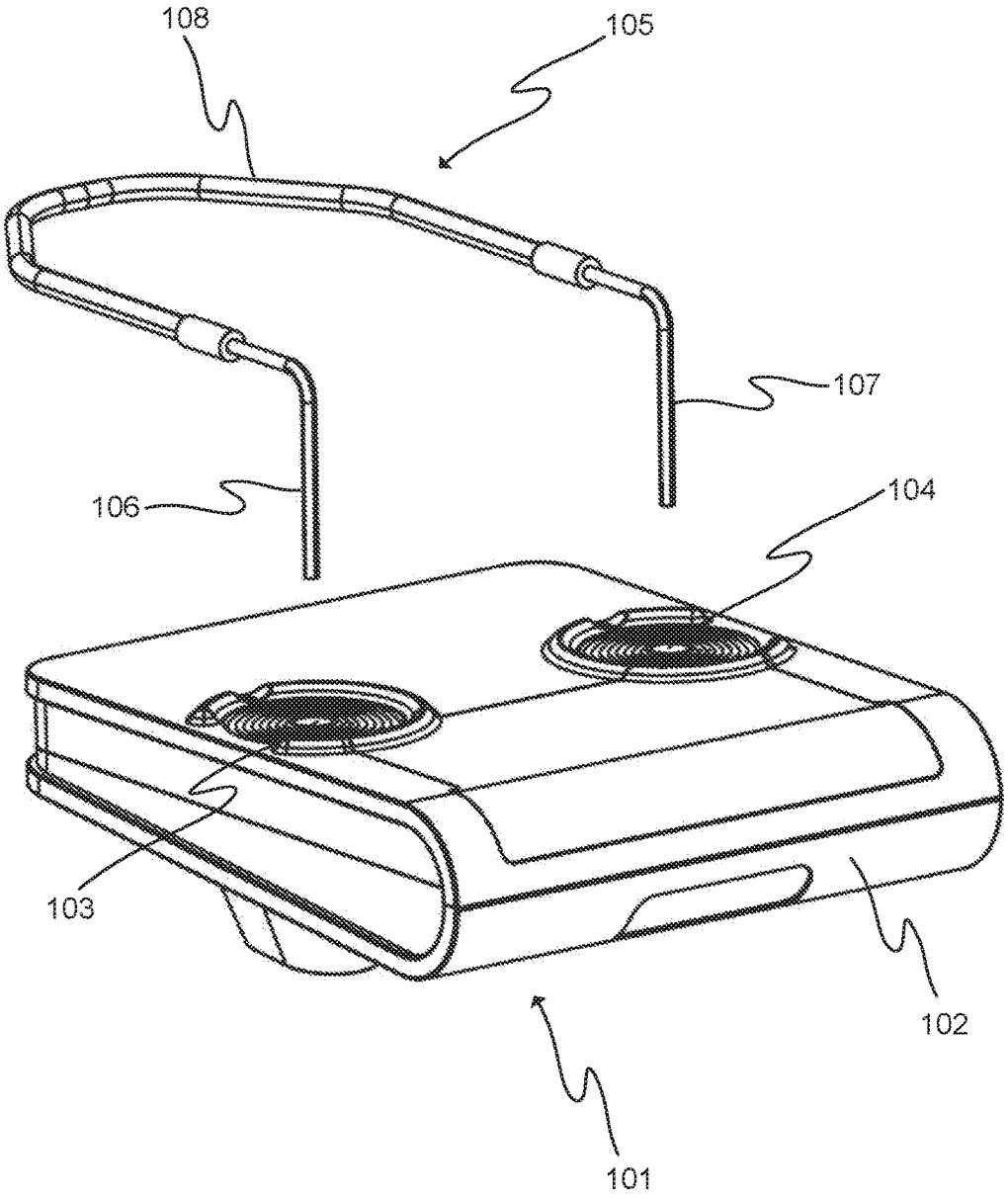
FIG. 1 illustrates a perspective view of an EAS tag according to an embodiment.

FIG. 1 illustrates a perspective view of an EAS tag 101 according to an embodiment. The EAS tag 101 comprises a body 102, which has a first aperture 103 and a second aperture 104. A lanyard 105 is used as an attaching element. The lanyard 105 has a first pin 106 at its first end and a second pin 107 at its second end. The lanyard 105 comprises a conducting wire 108 which is connected to the first pin 106 and the second pin 107. The first pin 106 at the first end of the lanyard 105 is arranged to be inserted to a first receptacle (not shown in FIG. 1) through the first aperture 103 of the EAS tag body 102. The second pin 107 at the second end of the lanyard 105 is arranged to be inserted to a second receptacle (not shown in FIG. 1) through the second aperture 104 of the EAS tag body 102.

Figure 2:
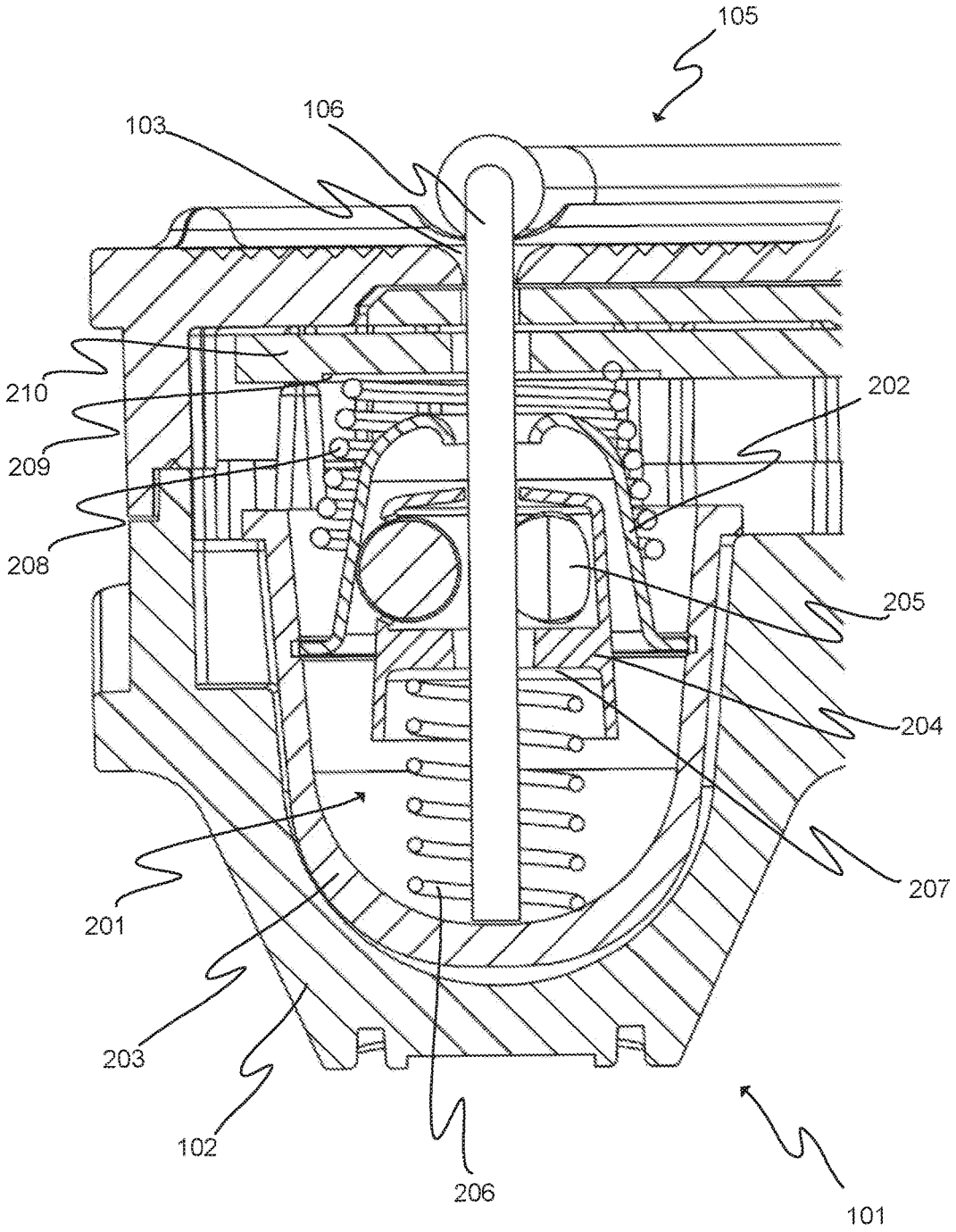
FIG. 2 illustrates a receptacle of the EAS tag with a pin according to an embodiment.

FIG. 2 illustrates a cross-sectional view of a first receptacle 201 assembled in the EAS tag 101 and the first pin 106 locked in the receptacle 201 according to one embodiment of the invention. The receptacle 201 comprises a cone shaped cup 202, which is open at the large end of the cone and attached to an outer cap 203 which rests at the bottom of the EAS tag body 102. The cone shaped cup 202 has an aperture at the small end of a cone through which the pin 106 is inserted. The receptacle 201 also comprises a ball cage 204, which is cylindrical and sized to fit into the cone shaped cup 202. The ball cage 204 has apertures for admitting balls 205 into an inner space of the ball cage 204. The ball cage 204 has also an aperture for receiving the pin 106 at the top of its axis. The ball cage 204 with the balls 205 is assembled in the cone shaped cup 202, so that the balls 205 have a contact with an inner surface of the cone shaped cup 202. This contact with the electrically conductive material of the cone shaped cup 202 and the balls 205 enables the electrical connection between them. A first spring 206 is assembled between a bottom of the outer cap 203 and a spring plate 207 of the ball cage 204 for supporting the ball cage 204 into the cone shaped cup 202 when inserting or releasing the pin 106.

An electrically conductive second spring 208 is placed between the cone shaped cup 202 and a contact pad 209 of a circuit board 210 inside the EAS tag body 102. The second spring 208 is cone shaped, thus, a diameter of the spring 208 is larger at a first end than at a second end. The last four coils from the first end are in contact with an outer surface of the cone shaped cup 202 to enable an electrical connection between the cone shaped cup 202 and the second spring 208. The second end of the second spring 208 is coupled to the contact pad 209 of the circuit board 210 to have the electrical connection between the cone shaped cup 202 and the circuit board 210.

The pin 106 is inserted into the EAS tag 101 through the aperture 103 in the EAS tag body 102. When the pin is pushed to the receptacle 201, the ball cage 204 moves slightly down inside the cone shaped cup 202. The conical shape of the cup gives a space to the balls 205 to receive the pin 106. The first spring 206 supports the ball cage 204 into the cone shaped cup 202, thus, maintaining the contact between the cone shaped cup 202, balls 205 and pin 106. If an attempt is made to withdraw the pin 106 from the receptacle 201, the balls 205, pin 106 and cone shaped cup 202 create a wedging action preventing the pin 106 from being withdrawn. As the ball cage 204 is made of a magnetically attractable material, a magnet could be used to release the pin 106 from the receptacle 201. In a situation of a removal of the pin 106, the magnet is applied to the back side of the receptacle 201. The magnet attracts the ball cage 204 to move down inside the cone shaped cup 202 and the conical shape of the cup gives a space to the balls 205 and the pin 106. This allows the pin 106 to be released from the receptacle 201.

The first receptacle 201 is electrically coupled to a microcontroller (not shown in FIG. 2) via the contact pad 209 of the circuit board 210. The second receptacle is electrically coupled to the microcontroller via another contact pad of the circuit board 210 (not shown in FIG. 2). The first pin 106 is at the first end of the lanyard 105 and is locked to the first receptacle 201. The second pin 107 is at the second end of the lanyard 105 and is locked to the second receptacle (not shown in FIG. 2). When both pins 106, 107 are locked to the receptacles, the pins 106, 107 are electrically coupled to the microcontroller and the electric current can be conveyed via the lanyard 105. Thus, the microcontroller can detect if the pin 106 is in place in the receptacle 201 or not, or if the lanyard 105 is broken.

Figure 3:
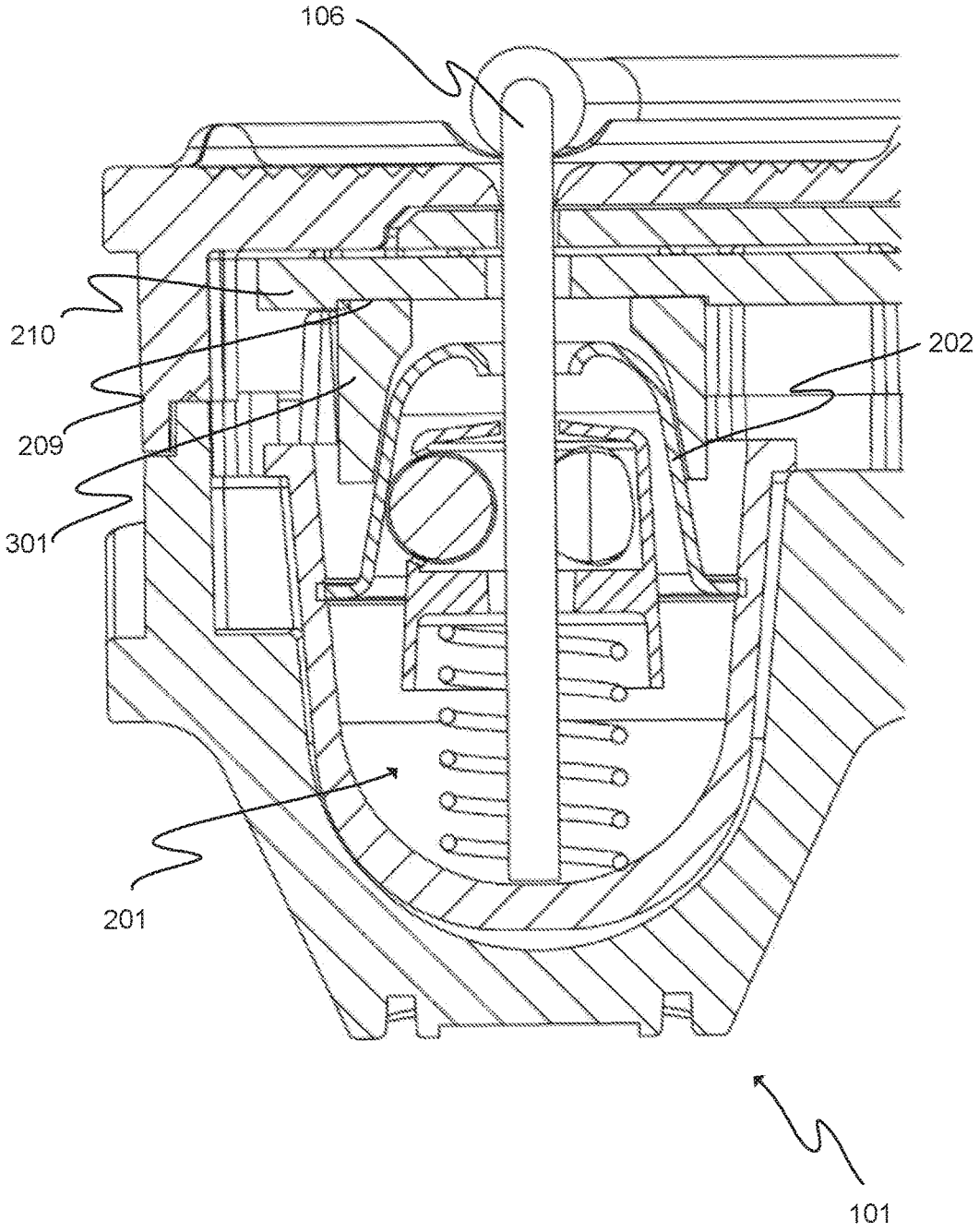
FIG. 3 illustrates a receptacle of the EAS tag with a pin according to another embodiment.

FIG. 3 illustrates a cross-sectional view of the first receptacle 201 assembled in the EAS tag 101 and the first pin 106 locked in the receptacle 201 according to another embodiment of the invention. The receptacle 201 comprises the same locking mechanism as the receptacle 201 in FIG. 2. The difference between the EAS tag 101 of FIG. 2 and the EAS tag 101 of FIG. 3 is that a foam 301 is used as a conductive element instead of the spring. The foam 301 is flexible, electrically conductive and perforated and is assembled between the cone shaped cup 202 and the contact pad 209 of the circuit board 210. A first end of the foam 301 is in contact with the outer side surface of the cone shaped cup 202 and a second end of the foam 301 is in contact with the contact pad 209 of the circuit board 210. When the pins 106, 107 are inserted to the receptacles, the conduction of the electricity between the receptacles occurs in the same way as explained in FIG. 2.

Only advantageous exemplary embodiments of the invention are described in the figures. It is clear to a person skilled in the art that the invention is not restricted only to the examples presented above, but the invention may vary within the limits of the claims presented hereafter. Some possible embodiments of the invention are described in the dependent claims, and they are not to be considered to restrict the scope of protection of the invention as such.

The invention claimed is:

1. An electronic article surveillance tag, comprising at least one receptacle for receiving a pin, wherein each of the at least one receptacle comprises:

a plurality of balls supported by a ball cage for releasably locking the pin in the receptacle;

a cone shaped cup arranged in contact with the plurality of balls;

a first spring for supporting the ball cage into the cone shaped cup; and a conductive element having a first end and a second end, the first end being arranged in contact with the cone shaped cup and the second end being arranged in contact with a contact element inside the electronic article surveillance tag for conducting electrical current between the pin and the contact element, wherein the at least one receptacle is inside the electronic article surveillance tag.

2. The electronic article surveillance tag according to claim 1, wherein the conductive element is a second spring.

3. The electronic article surveillance tag according to claim 2, wherein the second spring is a conical coil spring.

4. The electronic article surveillance tag according to claim 3, wherein the diameter of the conical coil spring is larger at the first end than at the second end.

5. The electronic article surveillance tag according to claim 3, wherein an inner surface of at least one coil of the second spring is in contact with the outer surface of the cone shaped cup.

6. The electronic article surveillance tag according to claim 2, wherein the plurality of balls, the cone shaped cup and the second spring are made of an electrically conductive material.

7. The electronic article surveillance tag according to claim 1, wherein the ball cage and the plurality of balls are arranged inside the cone shaped cup, so that the balls are in contact with the inner surface of the cone shaped cup.

8. The electronic article surveillance tag according to claim 1, wherein the contact element is a contact pad of a circuit board.

9. The electronic article surveillance tag according to claim 1, wherein the first spring has a first end and a second end, the first end being arranged in contact with the bottom of the receptacle.

10. The electronic article surveillance tag according to claim 9, wherein the second end of the first spring is arranged in contact with a spring plate of the ball cage.

11. The electronic article surveillance tag according to claim 1, wherein the electronic article surveillance tag comprises an attaching element having at least one pin that can be inserted and locked into the receptacle.

12. The electronic article surveillance tag according to claim 11, wherein the pin has a groove for engaging with the plurality of balls.

13. The electronic article surveillance tag according to claim 11, wherein the pin is made of an electrically conductive material.

* * * * *